US008540823B2

(12) United States Patent
Drehs et al.

(10) Patent No.: US 8,540,823 B2
(45) Date of Patent: Sep. 24, 2013

(54) LIQUID CLEANING COMPOSITIONS WITH FILMS

(75) Inventors: Karen Drehs, Hillsborough, NJ (US); Amjad Farooq, Hillsborough, NJ (US); Thomas Boyd, Metuchen, NJ (US); Cynthia McCullar Murphy, Belle Meade, NJ (US); Melissa Fleckenstein, Clark, NJ (US)

(73) Assignee: Colgate-Palmolive Company, New York, NY (US)

( * ) Notice: Subject to any disclaimer, the term of this patent is extended or adjusted under 35 U.S.C. 154(b) by 27 days.

(21) Appl. No.: 13/264,779

(22) PCT Filed: Apr. 23, 2010

(86) PCT No.: PCT/US2010/032189

§ 371 (c)(1),
(2), (4) Date: Oct. 17, 2001

(87) PCT Pub. No.: WO2010/126789

PCT Pub. Date: Nov. 4, 2010

(65) Prior Publication Data

US 2012/0035092 A1 Feb. 9, 2012

Related U.S. Application Data

(63) Continuation-in-part of application No. PCT/US2010/031717, filed on Apr. 20, 2010.

(60) Provisional application No. 61/174,684, filed on May 1, 2009.

(51) Int. Cl.

| | |
|---|---|
| ***B08B 3/04*** | (2006.01) |
| ***C11D 1/00*** | (2006.01) |
| ***C11D 3/37*** | (2006.01) |
| ***C11D 3/50*** | (2006.01) |

(52) U.S. Cl.

USPC ..... 134/25.2; 134/25.3; 134/39; 134/40; 134/42; 510/101; 510/473; 510/475; 510/535; 8/137

(58) Field of Classification Search

USPC ..... 510/101, 473, 475, 535; 8/137; 134/25.2, 25.3, 39, 40, 42

See application file for complete search history.

(56) References Cited

U.S. PATENT DOCUMENTS

| | | | | |
|---|---|---|---|---|
| 2,503,280 | A | 4/1950 | Lockwood | |
| 2,507,088 | A | 5/1950 | Bradley | |
| 3,260,744 | A | 7/1966 | Ito et al. | |
| 3,320,174 | A | 5/1967 | Rubinfeld | |
| 3,372,188 | A | 3/1968 | Alston | |
| 3,741,911 | A | 6/1973 | Shane | |
| 4,209,417 | A | 6/1980 | Whyte | |
| 6,569,261 | B1 | 5/2003 | Aubay et al. | |
| 6,620,777 | B2 | 9/2003 | Heibel et al. | |
| 6,669,929 | B1 | 12/2003 | Boyd et al. | |
| 6,797,683 | B2 | 9/2004 | Shana'a et al. | |
| 7,049,274 | B2 * | 5/2006 | Ranade et al. | 510/101 |
| 7,410,649 | B2 | 8/2008 | Yoshimi et al. | |
| 2005/0043209 | A1 | 2/2005 | Schmeidel et al. | |
| 2005/0106112 | A1 | 5/2005 | Boyd et al. | |
| 2006/0189503 | A1 | 8/2006 | Gambogi et al. | |
| 2007/0010415 | A1 | 1/2007 | Kinscherf et al. | |
| 2007/0066507 | A1 | 3/2007 | Fleckenstein et al. | |
| 2007/0148213 | A1 | 6/2007 | Ibrahim et al. | |
| 2007/0196313 | A1 | 8/2007 | Scala et al. | |
| 2008/0014393 | A1 | 1/2008 | Denome et al. | |
| 2008/0024281 | A1 | 1/2008 | Shimura | |

FOREIGN PATENT DOCUMENTS

| | | | |
|---|---|---|---|
| DE | 735096 | | 5/1943 |
| WO | WO 2004/006967 | | 1/2004 |
| WO | WO 2004/020566 | | 3/2004 |
| WO | WO 2006/089057 | | 8/2006 |
| WO | WO 2007/022229 | * | 2/2007 |
| WO | WO 2007/130684 | | 11/2007 |

OTHER PUBLICATIONS

BASF the Chemical Company, 2009, Kollicoat® SR 30 D Poly (Vinyl Acetate) Dispersion 30 Per Cent Ph. Eur. Technical Information.

Dow, 2010, Methocel™ Products, Dow Excipients, http://www.dow.com/dowexcipients/products/methocel.htm, accessed Apr. 8, 2010.

International Search Report and Written Opinion in International Application No. PCT/US10/031717, mailed Aug. 18, 2010.

International Search Report and Written Opinion in International Application No. PCT/US10/032189, mailed Aug. 17, 2010.

* cited by examiner

*Primary Examiner* — Brian P Mruk

(74) *Attorney, Agent, or Firm* — Michael F. Morgan

(57) ABSTRACT

A cleaning composition that contains film flakes with beneficial ingredients. The composition with the film flakes releases the beneficial ingredients when it is delivered to the target surface.

28 Claims, No Drawings

LIQUID CLEANING COMPOSITIONS WITH FILMS

CROSS REFERENCE TO RELATED APPLICATIONS

The present application is a national stage entry under 35 U.S.C. §371 of International Patent Application No. PCT/US10/32189, which is a continuation in part application of PCT/US10/31717, which was filed 20 Apr. 2010, which claims priority to U.S. Provisional Patent Application No. 61/174,684, which was filed on 1 May 2009, both of which are incorporated herein by reference.

BACKGROUND

A pleasant fragrance is one of important attributes that consumers expect from household cleaning compositions. For example, in dish washing liquids or hard surface cleaners, it is highly desirable to have a cleaning composition that combines high cleaning efficacy and pleasant fragrance as an additional benefit or indicator for cleanliness. Typically, a cleaning composition contains a surfactant system and a fragrance that is dissolved or dispersed in the composition. Such a composition needs to contain a relatively large amount of fragrance since the fragrance tends to be diluted and washed away as the composition is utilized.

It is highly desirable to have a cleaning composition that can release or activate fragrance while the composition is being utilized for its intended purpose such that a reduced amount of fragrance can be included in the composition without sacrificing the level of fragrance experience for the user. It is also desirable to have a cleaning composition that both provides aesthetically pleasing features and improved fragrance properties. There have been attempts to include fragrance particles in a cleaning composition to more efficiently deliver fragrances. However, such attempts do not address the aesthetic features of cleaning compositions.

Structured liquids are known in the art for suspending beads in liquid cleaning compositions. The means for providing the structure to the liquid includes using particular surfactants that thicken the liquid, using salt, or by adding thickening agents such as polymers and gums to thicken the liquid so as to be able to suspend beads. The beads can be designed to provide aesthetic appeals to enhance consumer acceptance and usage. For example, the beads can include pigments or colorants to provide aesthetic features in the cleaning composition. However, the general spherical configuration of a bead may not always be an optimal configuration to provide the aesthetic and other beneficial properties.

An alternative configuration for a bead is a film fragment. For example, a toothpaste product with film fragments, which product has a water-activity of about 0.8, is commercially available and the film fragments are stable in the product. However, a film fragment, which has a larger surface area than a bead, tends to pose dimensional and compositional stability challenges. A film fragment is more prone to dissolve or deform in a structured liquid. The stability issues are more pronounced when the structured liquid has high water and surfactant contents. However, a film fragment cannot be merely designed to make it completely insoluble or stable since the fragment may interfere with the performance and properties of the cleaning composition.

SUMMARY

A cleaning composition that has improved fragrance delivery and aesthetic properties. The cleaning composition contains film flakes or fragments in a surfactant system. The cleaning composition contains at least one surfactant, and a plurality of film flakes. The composition has a water activity higher than 0.9 and a surfactant content of at least 15%, based on the total weight of the composition, wherein the film flake contains a polymer system and a composition beneficial ingredient, wherein the film flake has a solubility in water of 40% to 60%. The cleaning composition is capable of suspending the plurality of film flakes. The film flake may include a water-soluble polymer, a water-insoluble polymer and a beneficial ingredient, such as fragrance.

In another embodiment, a composition comprising at least one surfactant, a plurality of film flakes, and water, wherein the composition is capable of suspending the plurality of film flakes, wherein the film flake comprises a polymer system and a beneficial ingredient, wherein the polymer system comprises hydroxypropyl methylcellulose and polyvinyl acetate, and wherein the film flake has a solubility in water of 40% to 60%.

In another embodiment, a composition comprising at least one surfactant, a plurality of film flakes, and water, wherein the composition is capable of suspending the plurality of film flakes, wherein the composition is capable of suspending the plurality of film flakes, wherein the film flake comprises a polymer system and a beneficial ingredient, wherein the polymer system comprises polyvinyl acetate, and wherein the film flake has a solubility in water of 40% to 60%.

The invention also provides a method for delivering delayed fragrance release from a composition. The method includes contacting the composition with water to dilute the composition.

The cleaning composition provides delayed release of beneficial agents that are included in the film flake. For example, when a fragrance compound is used as a beneficial agent, the fragrance is released when the composition applied and used, creating a bloom effect of fragrance at the time of use.

DETAILED DESCRIPTION

As used throughout, ranges are used as a shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

This invention provides a liquid cleaning composition that contains flakes or fragments of a film. The film flake adds aesthetic desirable features to the composition as well as provides additional beneficial ingredients. The film flake can deliver or release the beneficial ingredient contained therein by mechanical action during use and/or by diluting the composition with water. The film flake is stable in the cleaning composition that has a high water content and a high surfactant content, and yet it disintegrates or dissolves readily when the composition is diluted, thereby releasing the beneficial ingredients included in the film flake.

The present invention is for illustration purposes described with dishwashing liquid compositions, although the present invention can be utilized with liquid cleaning or detergent components, such as, hard surface cleaners, bathroom cleaners, shampoos, and body washes. Additionally, the invention is described with a fragrance as one exemplary ingredient that can be delivered with the film flake of the present invention. A desirable dishwashing composition is characterized by the properties of grease removal and fragrance delivery. Fragrance delivery includes evaluations of fragrance release and perception that can be measured quantitatively, qualitatively, objectively and/or subjectively, such as fragrance release, fragrance impact, fragrance longevity, user's perception of freshness and/or elimination or amelioration of malodor. The invention also includes a method for delivering a fragrance with a cleaning composition.

The film flake is produced from a film composition that contains one or more of polymers, and an unbound or free fragrance composition, which is dispersed or dissolved in the film composition without extraneous carriers or carrier matrix. It is advantageous for the film flake to include unbound fragrance compounds since the fragrance is readily released when the film flake is dissolved or disintegrated. However, particulate or encapsulated fragrances can be added as an optional ingredient.

The film flake is stable in aqueous cleaning compositions that have a high content of one or more of surfactants, but the flake is designed to disintegratable or dissolvable when the composition is applied to the target area and diluted with water with or without a mechanical agitation, such as stirring, rubbing or scrubbing. Otherwise, the film composition contains a polymer system that is adapted to have a targeted solubility such that the film flake is stable in an undiluted surfactant composition, but is readily soluble or disintegratable when the surfactant composition is diluted with water. Desirably, the film flake has a water-solubility of 40% to 60%, preferably 45% to 59%, whereas the film flake is stable in a cleaning composition that has a water-activity higher than 0.9, desirably higher than 0.95, and a surfactant content higher than 15%, desirably higher than 20%, based on the total weight of the cleaning composition. The water-solubility is tested with the following procedure at 25° C. One gram of a sample having 2 mm length, 2 mm width and 1 mm thickness is added in a 400 ml beaker, and 400 ml of distilled water is added. The content is stirred vigorously with a magnetic stirrer set at 300 rpm, for 30 minutes. Then, the mixture is filtered through a folded qualitative sintered-glass filter with a maximum pore size of 50 micrometer. The water is dried off from the collected filtrate by any conventional method, and the weight of the remaining material, which is the dissolved fraction, is determined. Then, the % solubility is calculated. The water-activity can be determined with a water-activity meter. A suitable water-activity meter is available from Decagon Devices, Inc. under the trade name AQUA LAB™, Model No. CX-2.

The flake may be produced from a polymer or a mixture of polymers that provide a desired water-solubility. When a mixture of polymers is used, it may be a mixture of a water-soluble polymer and a water-insoluble polymer. The term water-soluble polymer as used herein indicates a polymer that dissolves completely in water at a temperature less than 100° C., provided that a sufficient volume of water is present to avoid saturation. Suitable water-soluble polymers include homopolymers and copolymers such as polyvinyl alcohol, polyvinyl pyrrolidone, polyalkylene oxides, cellulose ethers, water-soluble acrylate copolymers, and mixtures thereof. Preferred water-soluble polymers include polyvinyl alcohols, polyvinyl pyrrolidone, polyalkylene oxides, cellulose ethers, water-soluble acrylate copolymers, carboxymethylcellulose sodium, hydroxyethyl cellulose, hydroxypropyl methylcellulose, and mixtures thereof. Most preferred are polyvinyl alcohols, polyvinyl pyrrolidone and hydroxypropyl methyl cellulose (HPMC) and mixtures thereof. The polymer can have any weight average molecular weight, preferably 1000 to 1,000,000, or even 10,000 to 300,000 or even 15,000 to 200,000 or even 20,000 to 150,000. Suitable water-insoluble polymers include cellulose, cellulose acetate, cellulose nitrate, ethylene-vinyl acetate copolymers, polyvinyl acetate, ethyl cellulose, butyl cellulose, isopropyl cellulose, shellac, silicone polymer (e.g. dimethylsilicone), acrylic polymers, cellulose acetate phthalate and natural or synthetic rubber, polyethylene, polypropylene, polyesters, polyurethane, polyamide, and mixtures thereof. Preferred water-insoluble polymers include cellulose, polyvinyl acetate, silicone polymers and mixtures thereof. In one embodiment, the polymer system comprises polyvinyl acetate. In certain embodiments, the amount of polyvinyl acetate is at least 1, 10, 20, 30, 40, 50, 60, 70, 80 or 90 weight % of the polymer system up to 100%. Increasing polyvinyl acetate can lead to an increase in the stability of the flakes in the composition.

An exemplary film can be produced from a film composition containing a mixture of polyvinyl acetate (PVAc) and HPMC. In one embodiment, the amount of polyvinyl acetate is 1 to 99 weight % of the polymer system, and the HPMC is 99 to 1 weight % of the polymer system. As a desired embodiment, the film is produced from an aqueous polymer system such that a volatile or organic solvent is not utilized. For example, a suspension of PVAc is mixed with HPMC to form an aqueous mixture such that there is no volatile or organic solvent that needs to be removed. An example of a suitable PVAc suspension is commercially available from BASF under the trade name KOLLICOAT™ SR 30 D. HPMC is available commercially, for example, from the Dow Chemical Company under the trade designation Methocel™, including, for example, Methocel™ E5LV, Methocel™ E50, and Methocel™ K100. Methocel™ E5 LV is a USP grade, low viscosity HPMC having 28 to 30 (29.1) % methoxyl groups and 7 to 12 (9) % hydroxypropyl group substitution. As used herein, hydroxypropyl methylcellulose E5 refers to hydroxypropyl cellulose have a viscosity of about 5 (4 to 6) mPas (cps), and hydroxypropyl methylcellulose E50 refers to hydroxypropyl cellulose have a viscosity of about 50 (40 to 60) mPas (cps). The viscosity for the hydroxypropyl cellulose is measured in a 2 weight % solution in water at 20° C. with a Ubbelohde tube viscometer.

In one embodiment, the polymer system comprises E5 hydroxypropyl methyl cellulose and polyvinyl acetate. In another embodiment, the polymer system comprises E5 hydroxypropyl methyl cellulose, E50 hydroxypropyl methylcellulose, and polyvinyl acetate. The following percentages are based on the total, active weight of the polymer system in the film. In one embodiment, the polymer system comprises about three times the amount of E5 hydroxypropyl methylcellulose by weight as the amount of polyvinyl acetate by weight. In one embodiment, the amount is about 76.9 weight % E5 hydroxypropyl cellulose and about 23.1% polyvinyl acetate. In one embodiment, the polymer system comprises 60 to 85, 65 to 85, 70 to 85, 75 to 85, 60 to 80, 65 to 80, or 70 to 80 weight % hydroxypropyl methylcellulose and 15 to 40, 15 to 35, 15 to 30, 20 to 40, 20 to 35, or 30 to 40 weight % polyvinyl acetate. In another embodiment, the polymer system comprises 70 to 85, 70 to 80, 75 to 85, or 75 to 80 weight % E5 hydroxypropyl methylcellulose and 15 to 30, 15 to 25, 20 to 30, or 20 to 25 weight % polyvinyl acetate. In another embodiment, the polymer system comprises 13 to 21, 14 to 19, or 15 to 19 weight % E50 hydroxypropyl methylcellulose, 47 to 68, 50 to 65, or 52 to 63 weight % E5 hydroxypropyl cellulose, and 15 to 35 or 18 to 32 weight % polyvinyl acetate. In another embodiment, the polymer system comprises about 18.75 weight % E50 hydroxypropyl methylcellulose 62.5 weight % E5 hydroxypropyl methyl cellulose, and 18.75 weight % polyvinyl acetate. In another embodiment, the polymer system comprises about 15.8 weight % E50 hydroxypropyl cellulose, about 52.6 weight % E5 hydroxypropyl cellulose, and about 31.6 weight % polyvinyl acetate.

In addition to the polymer system and the benefit ingredient, the film can contain additional materials to assist in forming and processing of the film. For example, the film can additionally contain propylene glycol, titanium dioxide, polysorbate 80, and corn starch, such as Hi-Set C™ from National Starch.

The film may be of any of a variety of shapes or forms, including semi-solid or solid discrete portions, fragments, flakes, or combinations thereof. In various embodiments, the film comprises a first plurality of fragments and a second plurality of fragments, wherein the first plurality of fragments differ in composition or appearance from the second plurality of fragments. Such difference in composition or appearance can be in any aspect of the composition of the fragment (e.g., different film components, different functional material, different formulation colorant), different appearance (e.g., shape, color, texture, refractive index, reflective index), or combinations thereof.

In various embodiments, the films exhibit perceivable contrast with the carrier. The perceivable contrast can be sensory contrast, such as optical contrast, tactile contrast, or olfactory contrast. In some configurations, optical contrast can be color contrast, or a difference in refractive index or reflective index. In some configurations, color contrast can be imparted by one or more colorants that comprise different components of the composition. In various embodiments, the present invention provides compositions comprising a plurality of films in a carrier, wherein the films are visibly discernable. As referred to herein, "visibly discernable" refers to one or more characteristics of a fragment that causes the film to have a different physical appearance, preferably to the naked eye, relative to the carrier in which the fragment is entrained. Such characteristics include color, opacity, refractive index, reflective index, size, shape, and combinations thereof.

In various embodiments, the films have a non-random shape. In one embodiment, a "non-random" shape is a shape that results from a manufacturing process of shaping, cutting, or other forming process by which a specific shape is imparted to a film. In such embodiments, a non-random shape is distinguished from such shapes that result from simple precipitation or grinding of a material. In one embodiment, a "non-random" shape is "repeating," wherein the composition comprises a plurality of films that have substantially the same shape. Such repeating shape may have any of a variety of fowls, and may be selected based on a variety of aesthetic or functional criteria. In certain embodiments, the shape of a film fragment can be a recognizable shape. In certain embodiments, a film fragment can comprise a nonrandom shape. Such shapes include simple geometric shapes, such as polygons and elliptical shapes, such as triangles, quadrilaterals (such as a square, a rectangle, a rhombus), pentagons, hexagons, oval, and circles. In one embodiment, the repeating shape is a square. Repeating shapes include, in other embodiments, shapes that are representative of figures or animate or inanimate objects, such as stars, hearts, gems, flowers, trees, shamrocks, a letter of an alphabet, numbers, animals, people, and faces. In various embodiments, the composition comprises a single repeating shape. In other embodiments, the composition comprises a plurality of films having a plurality of repeating shapes. In one embodiment, the composition comprises a plurality of first film fragments having a first repeated shape and a plurality of second film fragments having a second repeated shape, wherein the first repeated shape is different from the second repeated shape.

In various embodiments, the size of the films is not critical, and may be determined pursuant to any of a variety of criteria, including manufacturing convenience, affect on visual appearance, surface area, affect on texture in the composition, and combinations thereof. In some embodiments, the films can be up to about 2.54 cm (1 inch) in length in the longest dimension. As referred to herein, "longest dimension" is the dimension of a film in length or width (i.e., in the x- and y-dimensions, as the film is, or is deformed to be, in a planar shape) in a dimension substantially perpendicular to the "thickness" or shortest dimension of the film (i.e., the z-dimension). It is understood that in various embodiments comprising a plurality of films, the films may be present in a range of sizes due to a variety of factors, including random variation in size, manufacturing tolerances, and intentional sizing or mixing of the films through sieving or similar means. As referred to herein, sizes refer to the average size of films in a given plurality of films.

In various embodiments, the films are from 0.2 mm to 15 mm in a longest dimension. In various embodiments, the longest dimension of the films is 0.2 mm to 10 mm, 0.5 mm to 10 mm, 0.9 mm to 5 mm, or 1.5 mm to 2.5 mm. In some embodiments, the longest dimension of the films is at least 3 mm, and can be 6 mm to 13 mm. In certain embodiments, a plurality of films is greater than 600 microns in the longest dimension. In certain embodiments, a plurality of films is greater than 1 millimeter in the longest dimension.

In various embodiments, the films have a thickness of from about 25.4 μm (1 mil) to about 76.2 μm (3 mils). In various embodiments, the films have a thickness of from 2.54 μm (0.1 mils) up to 254 μm (10 mils), 12.7 μm (0.5 mils) to 127 μm (5 mils), or 35.6 μm (1.4 mils) to 50.8 μm (2 mils).

In some embodiments, the films have an aspect ratio of at least 5:1. As referred to herein, "aspect ratio" of a film is the ratio of the diameter of the smallest imaginary sphere that can enclose the object to the diameter of the largest imaginary sphere that can be completely inside the object and tangent to the surfaces of the object. For example, the aspect ratio of a sphere is 1:1; in another example, the aspect ratio of a cylinder that is 50.8 mm (2 inches) long and 3.35 mm (0.25 inches) in diameter is slightly over 8:1. In another example, a film that is 25.4 μm (1 mil) thick, 25.4 mm (1 inch) in length, and 25.4 mm (1 inch) wide has an aspect ratio of about 1414:1. In some embodiments, the films have an aspect ratio of at least 10:1. In various embodiments, the films have an aspect ratio of 5:1 to 10,000:1, 10:1 to 1,000:1, 20:1 to 100:1, or 25:1 to 35:1.

The film composition includes one or more of beneficial ingredients in addition to the polymer system. Suitable beneficial ingredients include fragrances, softeners, surfactants, emollients, vitamins, and sensates, such as cooling and heating agents. For example, the film composition may include one or more of fragrance compounds. The fragrance compound can be a fragrance precursor material, which upon a pH change, can release a fragrance. Also, the fragrance can be encapsulated. A wide variety of odiferous chemical compounds can be included in the film composition. Fragrance compounds include compounds used as perfumes and fragrances such as aldehydes, e.g., $C_6$-$C_{14}$ alipatic aldehydes and $C_6$-$C_{14}$ acyclic terpene aldehydes, ketones, alcohols, and esters. Suitable fragrance compounds include citral; neral; iso-citral; dihydro citral; citronellal; octanal; nonanal; decanal; undecanal; dodecanal; tridecanal; 2-methyl decanal; methyl nonyl acetaldehyde; 2-nonen-1-al; decanal; undecenal; undecylenic aldehyde; 2,6 dimethyl octanal; 2,6,10-trimethyl-9-undece-1-nal; trimethyl undecanal; dodecenal;

melonal; 2-methyl octanal; 3,5,5, trimethyl hexanal and mixtures thereof. Fragrances may also include pro-fragrances such as acetal pro-fragrances, ketal pro-fragrances, ester pro-fragrances (e.g., digeranyl succinate), hydrolyzable inorganic-organic profragrances, and mixtures thereof. These pro-fragrances may release the perfume material as a result of simple hydrolysis. The film composition may contain 5% to 40%, preferably 10% to 25%, based on the total solid weight of the film composition, of a fragrance.

It has been discovered that the films lessen the interaction of the fragrance with the aqueous surfactant system. It was expected that the fragrance would have been less stable because fragrances are hydrophobic materials, and they would be expected to go into the micelles in an aqueous surfactant system.

The films provide a bloom during use of the cleansing composition. As the cleansing composition is added to water, such as to clean dishes when used as a dish liquid, the water solubilizes the film and releases the fragrance. Generally, there is little change in fragrance intensity during the first two minutes after the cleansing composition is added to water, and then there is an exponential increase in the fragrance intensity.

The film flake may additionally provide aesthetic properties that are distinguishable from the carrier of the cleaning composition. The aesthetic properties can be sensory contrast, such as optical contrast. The sensory contrast can be color contrast imparted by colorants such that the contrast is visually discernable. Desirable visual contrasts can be imparted by, for example, opacity, refractive index, reflective index, size, and shape. Colorants may be pigments or dyes, including metallic and pearlescent pigments, and may be introduced into the film composition as a solid or as a color concentrate (e.g., a dye-containing, particulate polyethylene). In various embodiments, the film composition includes a formulation colorant that imparts a color to the film flake. Any colorants well known in the art are suitable for use in the compositions of the invention. Formulation colorants among those useful herein include non-toxic water soluble dyes or pigments, such as, for example, metallic oxide "lakes." Suitable colorants may be approved for incorporation into a food or drug by a regulatory agency, such as FD&C or D&C pigments and dyes approved by the FDA for use in the United States. Suitable colorants also include a water insoluble inorganic pigment, such as titanium dioxide, chromium oxide green, phthalocyanine green, ultramarine blue, ferric oxide, metallic pigments such as aluminum flake pigments, pearlescent pigments such as pearlescent mica pigments, or a water insoluble dye flake. Suitable dye lakes include calcium or aluminum salts of an FD&C dye such as FD&C Green #1 lake, FD&C Blue #2 lake, D&C Red #30 lake or FD&C Yellow #15 lake. The film composition may contain a dye such as D&C Red #30. A white colorant may also be used, including titanium dioxide, titanium dioxide coated mica (e.g., Timiron), a mineral, or a clay. The film composition can additionally include ingredients, such as, a plasticizer, e.g., propylene glycol, surfactant, preservative, disintegration aid, and other ingredients.

A film composition is prepared, and then the film composition is formed into a film. A film can be made from the film composition in a variety of ways. The film may be prepared by forming a suspension or solution of the film composition including the polymer system. The suspension or solution is cast, roll-coated, or otherwise applied as a layer on a supporting substrate and dried to form a film. The drying step to form the film can be carried out in a method suitable for producing films. The drying process can be carried out at elevated temperature, but below the decomposition temperature of the polymers in the polymer system and preferably below the evaporation point of the fragrance. A conventional drying oven, drying terminal or vacuum drier can be used. The dried film is further processed or cut to form film flakes using any known methods, such as a roll or dye cutting process, before or after the dried film is removed from the supporting substrate.

The film flake can have different configuration depending on the intended use of the cleaning composition. In certain embodiments, the film flake may have a thickness of 0.0254 mm (1 mil) to 0.381 mm (15 mil). The flake may have a regular or irregular shape. In general, the flake typically has a three-dimensional configuration with two relatively flat or lamellar surfaces and has a length and a width that are larger than the thickness of the configuration. The film flake may have a length and a width, independently, of 1 to 5 mm, and the film flake may have a length to thickness ratio of 1 to 5, wherein the length of the ratio is the shortest length of the edge of a flat surface of the flake. It has been found that when the length to thickness ratio is higher than 6, the flake tends to curl at the edges to take on a deformed shape when placed in a cleaning composition.

The cleaning composition contains at least one surfactant. In certain embodiments, the at least one surfactant is present in an amount of 0.1 to 45, 1 to 15, 15 to 45, or 15-35 weight % of the composition depending on the type of composition. The cleaning composition can be formulated to be a dish liquid, a laundry detergent, a hard surface cleaner, a body wash/shower gel, a liquid hand soap, a shampoo, or a conditioner. For dish liquids embodiments, the cleaning composition contains at least 15% by weight of one or more of surfactants, based on the total weight of the cleaning composition. In other dish liquid embodiments, the amount of surfactant is at least 20%, at least 25%, at least 30%, at least 35%, or at least 40% by weight. The surfactant can be a surfactant or a combination of surfactants. Suitable surfactants include anionic, nonionic, cationic, amphoteric, or zwitterionic surfactants.

Suitable anionic surfactants include, but are not limited to, those surface-active or detergent compounds that contain an organic hydrophobic group containing generally 8 to 26 carbon atoms or generally 10 to 18 carbon atoms in their molecular structure and at least one water-solubilizing group selected from sulfonate, sulfate, and carboxylate so as to form a water-soluble detergent. Usually, the hydrophobic group will comprise a $C_8$-$C_{22}$ alkyl, or acyl group. Such surfactants are employed in the form of water-soluble salts and the salt-forming cation usually is selected from sodium, potassium, ammonium, magnesium and mono-, di- or tri-$C_2$-$C_3$ alkanolammonium, with the sodium, magnesium and ammonium cations again being the usual ones chosen.

Suitable anionic surfactants include, but are not limited to, the sodium, potassium, ammonium, and ethanolammonium salts of linear$C_8$-$C_{16}$ alkyl benzene sulfonates, alkyl ether carboxylates, $C_{10}$-$C_{20}$ paraffin sulfonates, $C_8$-$C_{25}$ alpha olefin sulfonates, $C_8$-$C_{18}$ alkyl sulfates, $C_8$-$C_{18}$ alkyl ether sulfates and mixtures thereof.

Other suitable anionic surfactants include paraffin sulfonates, which may be monosulfonates or di-sulfonates and usually are mixtures thereof, obtained by sulfonating paraffins of 10 to 20 carbon atoms. Commonly used paraffin sulfonates are those of $C_{12}$-$C_{18}$ carbon atoms chains, and more commonly they are of $C_{14}$-$C_{17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735, 096. Such compounds may be made to specifications and desirably the content of paraffin sulfonates outside the $C_{14}$-$C_{17}$ range will be minor and will be minimized, as will be any contents of di- or poly-sulfonates. Examples of paraffin sulfonates include, but are not limited to HOSTAPUR™ SAS30, SAS 60, SAS 93 secondary alkane sulfonates from Clariant, and BIO-TERGE™ surfactants from Stepan, and CAS No. 68037-49-0.

Examples of suitable other sulfonated anionic surfactants include higher alkyl mononuclear aromatic sulfonates, such as the higher alkylbenzene sulfonates containing 9 to 18 or 9 to 16 carbon atoms in the higher alkyl group in a straight or branched chain, or $C_8$-$C_{15}$ alkyl toluene sulfonates. In one embodiment, the alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Materials that can be used are found in U.S. Pat. No. 3,320,174, especially those in which the alkyls are of 10 to 13 carbon atoms.

Other suitable anionic surfactants include the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, or 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. In one embodiment, olefin sulfonates contain from 14 to 16 carbon atoms in the R alkyl group and are obtained by sulfonating an a-olefin.

Examples of satisfactory anionic sulfate surfactants include alkyl sulfate salts and ether sulfate salts. Suitable anionic ether sulfate has the formula $R(OC_2H_4)_nOSO_3M$ wherein n is 1 to 12, or 1 to 5, and R is an alkyl, alkylaryl, acyl, or alkenyl group having about 8 to about 18 carbon atoms, for example, an alkyl group of $C_{12}$-$C_{14}$ or $C_{12}$-$C_{16}$, and M is a solubilizing cation selected from sodium, potassium, ammonium, magnesium and mono-, di- and triethanol ammonium ions. Exemplary alkyl ether sulfates contain 12 to 15 carbon atoms in the alkyl groups thereof, e.g., sodium myristyl (3 EO) sulfate. Suitable alkylaryl ether sulfates include $C_8$-$C_{18}$ alkylphenyl ether sulfates containing from 2 to 6 moles of ethylene oxide in the molecule. Other suitable anionic detergents include the $C_9$-$C_{15}$ alkyl ether polyethenoxyl carboxylates. Suitable alkyl ether polyethoxyl carboxylates may be prepared by condensing ethylene oxide with appropriate alkanol and reacting this reaction product with chloracetic acid to make the ether carboxylic acids as shown in U.S. Pat. No. 3,741,911 or with succinic anhydride or phthalic anhydride.

Suitable nonionic surfactants utilized in this invention include the primary aliphatic alcohol ethoxylates, secondary aliphatic alcohol ethoxylates, alkylphenol ethoxylates and ethylene-oxide-propylene oxide condensates on primary alkanols, such a PLURAFAC™ surfactants (BASF) and condensates of ethylene oxide with sorbitan fatty acid esters such as the TWEEN™ surfactants (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

Desirably suitable nonionic surfactants include the NEODOL™ ethoxylates (Shell Co.), which are higher aliphatic, primary alcohol containing about 9-15 carbon atoms, such as $C_9$-$C_{11}$ alkanol condensed with 2 to 10 moles of ethylene oxide (NEODOL™ 91-2.5 OR −5 OR −6 OR −8), $C_{12}$-$C_{13}$ alkanol condensed with 6 to 7 moles ethylene oxide (NEODOL™ 23-6.5), $C_{12}$-$C_{15}$ alkanol condensed with 12 moles ethylene oxide (NEODOL™ 25-12), $C_{14}$-$C_{15}$ alkanol condensed with 13 moles ethylene oxide (NEODOL™ 45-13), and the like.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$-$C_{15}$ secondary alkanol condensed with either 9 EO (TERGITOL™ 15-S-9) or 12 EO (TERGITOL™ 15-S-12) marketed by Union Carbide.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include, but are not limited to, nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include IGEPAL™ CO-630 (nonyl phenol ethoxylate) marketed by GAF Corporation.

Also among the satisfactory nonionic surfactants are the water-soluble condensation products of a $C_8$-$C_{20}$ alkanol with a heteric mixture of ethylene oxide and propylene oxide wherein the weight ratio of ethylene oxide to propylene oxide is from 2.5:1 to 4:1, or 2.8:1 to 3.3:1, with the total of the ethylene oxide and propylene oxide (including the terminal ethanol or propanol group) being from 60-85%, or 70-80%, by weight. Such detergents are commercially available from BASF and a particularly preferred surfactant is a $C_{10}$-$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$-$C_{20}$ alkanoic acid esters having a HLB of 8 to 15 also may be employed as the nonionic detergent ingredient in the described composition. These surfactants are well known and are available from Imperial Chemical Industries under the TWEEN™ trade name. Suitable surfactants include, but are not limited to, polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic surfactants are marketed under the trade name PLURONIC™. The compounds are formed by condensing ethylene oxide with a hydrophobic base formed by the condensation of propylene oxide with propylene glycol. The molecular weight of the hydrophobic portion of the molecule is of the order of 950 to 4000 or 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. In one embodiment, these surfactants will be in liquid form and satisfactory surfactants are available as grades L 62 and L 64.

Alkyl polysaccharides surfactants, which can be used in the instant composition, have a hydrophobic group containing from about 8 to about 20 carbon atoms, or from about 10 to about 16 carbon atoms, or from about 12 to about 14 carbon atoms, and polysaccharide hydrophilic group containing from about 1.5 to about 10, or from about 1.5 to about 4, or from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In one embodiment, the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, or from about 10 to about 18 carbon atoms. In one embodiment, the alkyl group is a straight chain saturated alkyl group. The alkyl group can contain up to 3 hydroxy groups and/or the polyalkoxide chain can contain up to about 30, or less than about 10, alkoxide moieties.

Suitable alkyl polysaccharides include, but are not limited to, decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in a mixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

"Alkyl polysaccharide surfactant" is intended to represent both the glucose and galactose derived surfactants and the alkyl polysaccharide surfactants. Throughout this specification, "alkyl polyglucoside" is used to include alkyl polyglycosides because the stereochemistry of the saccharide moiety is changed during the preparation reaction.

Suitable alkyl polyglucosides include APG 625 glycoside manufactured by the Henkel Corporation of Ambler, Pa. APG 625 is a nonionic alkyl polyglycoside characterized by the formula:

$$C_nH_{2n+1}O(C_6H_{10}O_5)_xH$$

wherein n=10 (2%); n=122 (65%); n=14 (21-28%); n=16 (4-8%) and n=18 (0.5%) and x (degree of polymerization)=1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5-10 RPM of 3,000 to 7,000 cps.

Suitable zwitterionic surfactants include betaines and sultaines, such as, a water soluble betaine having the general formula

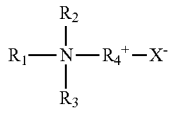

wherein $X^-$ is selected from $COO^-$ and $SO_3^-$ and $R_1$ is an alkyl group having 10 to about 20 carbon atoms, or 12 to 16 carbon atoms, or the amido radical:

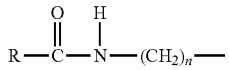

wherein R is an alkyl group having about 9 to 19 carbon atoms and n is the integer 1 to 4; $R_2$ and $R_3$ are each alkyl groups having 1 to 3 carbons and in one embodiment, 1 carbon; $R_4$ is an alkylene or hydroxyalkylene group having from 1 to 4 carbon atoms and, optionally, one hydroxyl group. Typical alkyldimethyl betaines include, but are not limited to, decyl dimethyl betaine or 2-(N-decyl-N,N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include, but are not limited to, cocoamidoethylbetaine, cocoamidopropyl betaine and the like. The amidosulfobetaines include, but are not limited to, cocoamidoethylsulfobetaine, cocoamidopropyl sulfobetaine and the like. In one embodiment, the betaine is coco ($C_8$-$C_{18}$) amidopropyl dimethyl betaine. Three examples of betaine surfactants that can be used are EMPIGEN™ BS/CA from Albright and Wilson, REWOTERIC™ AMB 13 and Goldschmidt Betaine L7.

Other suitable zwitterionic surfactants include amine oxides. An amine oxide is depicted by the formula:

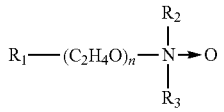

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms; $R_2$ and $R_3$ are each methyl, ethyl, propyl, isopropyl, 2-hydroxyethyl, 2-hydroxypropyl, or 3-hydroxypropyl; and n is from 0 to about 10. In one embodiment, the amine oxides are of the formula:

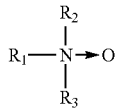

wherein $R_1$ is a $C_{12-18}$ alkyl and $R_2$ and $R_3$ are methyl or ethyl. The above ethylene oxide condensates, amides, and amine oxides are more fully described in U.S. Pat. No. 4,316,824. In another embodiment, the amine oxide is depicted by the formula:

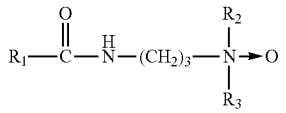

wherein $R_1$ is a saturated or unsaturated alkyl group having about 6 to about 24 carbon atoms, $R_2$ is a methyl group, and $R_3$ is a methyl or ethyl group. A preferred amine oxide is cocoamidopropyl-dimethylamine oxide.

One desirable surfactant for the cleaning composition is an alkyl benzene sulfonate surfactant. Another desirable surfactant is a surfactant system of a combination of an alkyl ether sulfonate, and a zwitterionic surfactant. Yet another desirable is a surfactant system of a combination of an alkyl benzene sulfonate, an alkyl ether sulfonate, and a zwitterionic surfactant. It may be desirable to include the cationic surfactant(s) in an amount of up to about 25% by weight, or up to about 10% by weight, or up to about 3% about by weight, of the total composition. It may be desirable to include the nonionic surfactant(s) in an amount of up to about 20% by weight, or up to about 10% by weight, or up to about 5% by weight of the total composition. In an embodiment it may be desirable to include the alkyl benzene sulfonate salt surfactant(s) in an amount of about 1% to about 40% by weight, or about 3% by weight to about 30% by weight, or about 5% to about 20% by weight of the total composition, with attention to the relative ratio various salts (of applicable), e.g., sodium to magnesium salts, as described above. In an embodiment it may be desirable to include the alkyl ether sulfate surfactant(s) in an amount of about 5% to about 40% by weight, or about 10% to about 25% by weight, or about 7% to about 19% by weight. In an embodiment it may be desirable to include the amine oxide surfactant(s) in an amount of up to about 25% by weight, or about 5% to about 20% by weight, or about 2% to about 10% by weight. In an embodiment it may be desirable to include the amphoteric surfactant(s) in an amount of up to about 30% by weight, or up to about 20% by weight, or up to about 10% by weight.

The cleaning composition may further include one or more of fragrance compounds in addition to the fragrance included in the film flake. A wide variety of odiferous chemical compounds can be utilized, including the fragrances disclosed above in conjunction with the film flakes. The fragrances in the cleaning composition and in the film flake may contain the same fragrance or different fragrances. It may be desirable to provide different fragrances to enhance user's experience and perception of the cleaning composition. The composition may include 0.01 wt % to 5 wt % of a fragrance compound.

In certain embodiments, the cleaning composition is a structured liquid composition that contains a structuring/suspending agent. Examples of structured liquids can be found in United States Patent Publication Nos. 2007/0010415A1 and 2007/0066507A1. A suspending agent is any material that increases the ability of the liquid detergent composition to suspend material. Examples of suspending agents include gum suspending agents and synthetic polymer suspending agents. Examples of gum suspending agents include, but are not limited to, microfibrous cellulose, gellan gum, pectine, alginate, arabinogalactan, carageenan, xanthum gum, guar gum, rhamsan gum, furcellaran gum, and combinations thereof. In one embodiment, the suspending agent is gellan gum, and it can be obtained from CP Kelco under the tradename KELCOGEL™. In one embodiment, the gellan gum is KELCOGEL™ AFT. In another embodiment, the suspending agent is a microfibrous cellulose, which is available from CP Kelco. An exemplary synthetic polymer suspending agent is a polyacrylate. One acrylate aqueous solution used to allow a stable suspension of the solid particles is manufactured by Noveon as Carbopol™ Aqua 30. The Carbopol resins, also known as "carbomer," are hydrophilic high molecular weight, crosslinked acrylic acid polymers having an average equivalent weight of 76, and the general structure illustrated by the following formula has a molecular weight of about 1,250,000; Carbopol™ 940 a molecular weight of approximately 4,000,000 and Carbopol™ 934 a molecular weight of approximately 3,000.000. The Carbopol™ resins are crosslinked with polyalkenyl polyether, e.g. about 1% of a polyalkyl ether of sucrose having an average of about 5.8 alkyl groups for each molecule of sucrose. The suspending agent can be included in the composition in any amount to give a desired amount of suspension. In one embodiment, the amount of suspending agent is 0.01-10% by weight of the composition.

The composition may also contain solvents or salts to modify the cleaning, stability and rheological properties of the composition. Solvents can include any water soluble solvents. Water soluble solvents include, but are not limited to, $C_{2-4}$ mono, dihydroxy, or polyhydroxy alkanols and/or an ether or diether, such as ethanol, isopropanol, diethylene glycol monobutyl ether, dipropylene glycol methyl ether, diproyleneglycol monobutyl ether, propylene glycol n-butyl ether, propylene glycol, and hexylene glycol, and alkali metal cumene, alkali metal toluene, or alkali metal xylene sulfonates such as sodium cumene sulfonate and sodium xylene sulfonate. In some embodiment, the solvents include ethanol and diethylene glycol monobutyl ether, both of which are miscible with water. Urea can be optionally used at a concentration of 0.1% to 7 weight %. Salts can be included in the composition, including sodium chloride and magnesium sulfate.

Additional optional ingredients may be included to provide added effect or to make the product more attractive. Such ingredients include, but are not limited to, encapsulated materials, encapsulated fragrances, coloring agents, dyes, pigments, abrasive agents, disinfectants, radical scavengers, bleaches, chelating agents, antibacterial agents/preservatives, optical brighteners, hydrotropes, or combinations thereof.

Preservatives can be included in the composition at a concentration of 0 wt. % to 3 wt. %, or 0.01 wt. % to 2.5 wt. %. Examples of preservatives include, but are not limited to, benzalkonium chloride; benzethonium chloride, 5-bromo-5-nitro-1,3dioxane; 2-bromo-2-nitropropane-1,3-diol; alkyl trimethyl ammonium bromide; N-(hydroxymethyl)-N-(1,3-dihydroxy methyl-2,5-dioxo-4-imidaxolidinyl-N-(hydroxy methyl)urea; 1-3-dimethyol-5,5-dimethyl hydantoin; formaldehyde; iodopropynl butyl carbamate, butyl paraben; ethyl paraben; methyl paraben; propyl paraben, mixture of methyl isothiazolinone/methyl-chloroisothiazoline in a 1:3 wt. ratio; mixture of phenoxythanol/butyl paraben/methyl paraben/propylparaben; 2-phenoxyethanol; tris-hydroxyethyl-hexahydrotriaz-ine; methylisothiazolinone; 5-chloro-2-methyl-4-isothiazolin-3-one; 1,2-dibromo-2,4-dicyanobutane; 1-(3-chloroalkyl)-3,5,7-triaza-azoniaadam-antane chloride; sodium benzoate; organic acids, lactic acid, or citric acid.

Solubilizing agents or hydrotropes such as a $C_1$-$C_3$ alkyl substituted benzene sulfonate such as sodium cumene or sodium xylene sulfonate and mixtures thereof can be added at a concentration of 0.5 wt. % to 10 wt. % to assist in solubilizing the surfactants.

Additional materials that can be included in the films or in the composition can be found in United States Patent Publication No. 2005/0106112A1 to Boyd et al. and United States Patent Publication No. 2007/0148213A1 to Ibrahim et al.

The viscosity of the composition can be adjusted to give any desired viscosity. The viscosity of the composition is less than 2,000 mPas, preferably 300-1500 mPas. Viscosity is measured using a Brookfield Viscometer using a number 21 spindle rotating at 20 rpm at 25° C. The liquid cleaning composition of the present invention is pourable.

The invention also includes methods of delivering fragrance to a space or the olfactory apparatus of a user by employing the cleaning composition in water under agitation or no agitation. By agitation it is meant any activities that disrupt the water into which the composition has been placed, thereby resulting in the volatilization of some of the components in the compositions.

Water activity is measured using a Metrohm Model 756 Coulometer. A 0.2 to 0.3 g of sample is used. The coulometer is run at 150° C. with a flow rate of 190±10 ml/min.

EXAMPLES

In the examples below, the amount listed for the polyvinyl acetate suspension is based on the as supplied weight of the material, which has 30 weight % PVA.

Example 1

Film Preparation

Films having the following ingredients are prepared.

TABLE 1

| | Film 1 (wt %) | Film 2 (wt %) | Film 3 (wt %) |
|---|---|---|---|
| HPMC E50 | 3 | 3 | 3 |
| HPMC E5 | 10 | 10 | 10 |
| Polyvinyl acetate suspension (30% PVAc) | 0 | 10 | 20 |
| Fragrance (Pearapple) | 10 | 10 | 10 |
| Propylene glycol | 1.5 | 1.5 | 1.5 |
| Titanium dioxide | 0.5 | 0.5 | 0.5 |
| Polyoxyethylene sorbitan monooleate | 0.5 | 0.5 | 0.5 |
| Cornstarch | 3 | 3 | 3 |
| Water | 71.5 | 71.5 | 71.5 |

Both grades of hydroxypropyl methylcellulose are gradually added into 66.5 g of water at 80° C. while mixing with an overhead mixer, and HPMC is fully hydrated. Polyvinyl acetate and propylene glycol are sequentially added, and then polyoxyethylene sorbitan monooleate is added. The cornstarch and titanium dioxide are mixed with 5 g of water to form a mixture, and the mixture is added to the beaker. The fragrance is added while being stirred to form a film composition. The film composition is cast onto a flat glass to form a film of a thickness of 0.5 mm (20 mil) and then the film is dried in an oven kept at 90° C. Onto the dried film a second layer of film is prepared by repeating the above procedure using the same film composition. Film 1 and Film 2 have the water-solubility values of 56% and 62%, respectively.

Alternatively, the films can be made as follows. For 100 g of slurry, heat 25 ml of de-ionized water to 90° C. Add HMPC E5 and mix for 5 minutes. Allow composition to cool to 60° C. Add 10 ml of water and HPMC 50 and slowly increase the speed of the mixer over 10 minutes. Allow the composition to cool to room temperature. Add corn starch, titanium dioxide, and remaining water and mix for 10-15 minutes. Add polyvinyl alcohol suspension and mix for 5-10 minutes. Add propylene glycol and polysorbate 80 (Tween™ 80 polyoxyethylene sorbitan monooleate) and mix for 5-10 minutes. Add fragrance and mix for 5 minutes. The slurry can be cast into films when mixing is complete.

To cast a film, heat a drying oven to 90° C. Cut a plastic sheet to desired size and adhere to a flat, glass cutting board. Pour slurry onto plastic sheet. Using a casting bar, spread the film in a 508 μm (20 mil) layer. Place board with film in drying oven for 14 minutes. Check to see if dry. If not, continue to dry. Remove when dry. If casting a second layer, repeat casting and drying steps. Store dried films in sealed container to avoid fragrance and moisture loss. Allow films to sit overnight before being added to a composition.

Example 2

Film Preparation

A film having the following ingredients is prepared.

TABLE 2

| | Film 4 (wt %) |
|---|---|
| HPMC E5 | 10 |
| Polyvinyl acetate suspension (30% PVAc) | 10 |
| Fragrance | 10 |
| Water | 70 |

A film is produced using the procedure of Example 1, except propylene glycol, titanium dioxide, polyoxyethylene sorbitan monooleate (Tween™ 80) and cornstarch are not added.

Example 3

Cleaning Composition

A cleaning composition is prepared by mixing the ingredients as shown below in Table 3.

TABLE 3

| | Composition 1 (weight %) | Composition 2 (weight %) | Composition 3 (weight %) |
|---|---|---|---|
| Mg linear alkyl benzene sulfonate (LAS) | 7.5 | 7.5 | |
| Na linear alkyl benzene sulfonate (LAS) | 21 | 21 | 25 |
| Amine Oxide | 1.6 | 1.6 | |
| Ammonium alkyl ether sulfate -1.3 EO | 2.1 | 2.1 | |
| Sodium Xylene Sulfonate (SXS) | 8.7 | 8.7 | |
| Diethylenetriaminepentaacetic acid | 0.7 | 0.7 | |
| Sodium chloride | 0.4 | 0.4 | |
| Preservative (DMDM hydantoin) | 0.2 | 0.2 | |
| Ethanol | 0.3 | 0.3 | |
| Sodium bisulfate | 0.2 | 0.2 | |
| Gellan gum | 12.7 | 12.7 | |
| Film flakes (Example 1) | 0.8 g (Film 2) | 0.8 g (Film 1) | 0.8 g (Film 2) |
| Water | 11.3 | 11.3 | 62 |
| Water solubility | 56% | 62% | |

The film flakes in Composition 1 are stable in the cleaning composition at room temperature, but the film flakes in Composition 2 gradually dissolve and diffuse into the cleaning composition. When Composition 1 is applied on a sponge applicator and diluted with water, and then is used to clean a cookware, noticeable amounts of additional fragrance are released.

Example 4

Cleaning Composition Panel Test 298.5 g of a cleaning composition is prepared by mixing the ingredients of above Composition 1, except the film flakes, and 1.5 g of a pearapple fragrance is added to the composition. The composition is designated as Composition 4. Into 99.2 g of Composition 4, 0.8 g of Film 2 from Example 1 is added, and gently mixed. The composition is designated as Composition 5. Into another 99.2 g of Composition 4, 1 g of the pearapple fragrance and 0.7 g of water are added, preparing Composition 6. Composition 6 contains approximately the same amount of the fragrance as Composition 5.1 g each of the three compositions is placed on a damp sponge, and six panelists are asked to hand wash a glass using the prepared sponge and running water at about 45° C. The panelists are asked to give fragrance intensity rating after 30 seconds of the washing using rating system of 1 to 10, 10 being the highest intensity.

TABLE 4

| Composition | Intensity (average) |
|---|---|
| 4 | 3.3 |
| 5 | 4.4 |
| 6 | 3.3 |

The panel test demonstrates that the composition of the present invention releases a perceivable fragrance concentration from the cleaning composition when the cleaning composition is applied and used. In comparison, Composition 6 demonstrates that merely adding an additional amount of fragrance is not likely to provide improved fragrance properties.

What is claimed is:

1. A cleaning composition comprising 15-45% of one or more surfactants, a plurality of film flakes, and water, wherein a combination of the surfactant and the water provides the composition with a water activity higher than 0.9, wherein the film flake comprises a polymer system and a beneficial ingredient, wherein the film flake has a solubility in water of 40% to 60%, and the cleaning composition is capable of suspending the plurality of film flakes, wherein the composition is liquid.

2. The cleaning composition of claim 1, wherein the polymer system comprises polyvinyl acetate.

3. The cleaning composition of claim 1, wherein the polymer system comprises a water-soluble polymer and a water-insoluble polymer.

4. The cleaning composition of claim 3, wherein the polymer system comprises at least one water-soluble polymer chosen from polyvinyl alcohol, polyvinyl pyrrolidone, polyalkylene oxides, cellulose ethers, and water-soluble acrylate copolymers.

5. The cleaning composition of claim 3, wherein the polymer system comprises at least one water-insoluble polymer chosen from cellulose, cellulose acetate, cellulose nitrate, ethylene-vinyl acetate copolymers, polyvinyl acetate, ethyl cellulose, butyl cellulose, isopropyl cellulose, shellac, silicone polymer, acrylic polymers, cellulose acetate phthalate, natural or synthetic rubber, polyethylene, polypropylene, polyesters, polyurethane, and polyamide.

6. The composition of claim 1, wherein the composition further comprises a suspending agent.

7. The composition of claim 1, wherein the beneficial ingredient is a fragrance compound.

8. The composition of claim 1, wherein the composition has a water activity higher than 0.95 and comprises a surfactant content of at least 20%, based on the total weight of the composition.

9. The composition of claim 1, wherein the polymer system comprises hydroxypropyl methylcellulose and polyvinyl acetate.

10. The composition of claim 1, wherein the polymer system comprises 60 to 85 weight % hydroxypropyl methylcellulose and 15 to 40 weight % polyvinyl acetate.

11. The composition of claim 1, wherein the polymer system comprises polyvinyl acetate and E5 hydroxypropyl methylcellulose.

12. The composition of claim 1, wherein the polymer system comprises 70 to 85 weight % E5 hydroxypropyl methylcellulose and 15 to 30 weight % polyvinyl acetate.

13. The composition of claim 1, wherein the polymer system comprises polyvinyl acetate, E5 hydroxypropyl methylcellulose, and E50 hydroxypropyl methylcellulose.

14. The composition of claim 1, wherein the polymer system comprises 13 to 21 weight % E50 hydroxypropyl methylcellulose, 47 to 68 weight% E5 hydroxypropyl cellulose, and 15 to 35 weight % polyvinyl acetate.

15. A method of delivering delayed release of fragrance, comprising contacting the cleaning composition of claim 1, in which composition the beneficial ingredient is a fragrance compound, with water to dilute the composition.

16. The method of claim 15, wherein the method further comprises a step of applying an agitating force after the cleaning composition is diluted with water.

17. A composition comprising 15-45 weight % of at least one surfactant, a plurality of film flakes, and water, wherein the composition is capable of suspending the plurality of film flakes, wherein the film flake comprises a polymer system and a beneficial ingredient, wherein the polymer system comprises hydroxypropyl methylcellulose and polyvinyl acetate, and wherein the film flake has a solubility in water of 40% to 60%, wherein the composition is a liquid, and wherein a combination of the surfactant and the water provides the composition with a water activity higher than 0.9.

18. The composition of claim 17, wherein the composition has a water activity higher than 0.95.

19. The composition of claim 17, wherein the composition further comprises a suspending agent.

20. The composition of claim 17, wherein the at least one surfactant is present in an amount of 15-35 weight % of the composition.

21. The composition of claim 17, wherein the polymer system comprises 60 to 85 weight % hydroxypropyl methylcellulose and 15 to 40 weight % polyvinyl acetate.

22. The composition of claim 17, wherein the polymer system comprises polyvinyl acetate and E5 hydroxypropyl methylcellulose.

23. The composition of claim 17, wherein the polymer system comprises 70 to 85 weight % E5 hydroxypropyl methylcellulose and 15 to 30 weight % polyvinyl acetate.

24. The composition of claim 17, wherein the polymer system comprises polyvinyl acetate, E5 hydroxypropyl methylcellulose, and E50 hydroxypropyl methylcellulose.

25. The composition of claim 17, wherein the polymer system comprises 13 to 21 weight % E50 hydroxypropyl methylcellulose, 47 to 68 weight % E5 hydroxypropyl cellulose, and 15 to 35 weight % polyvinyl acetate.

26. A method of delivering delayed release of fragrance, comprising contacting the composition of claim 17, in which composition the beneficial ingredient is a fragrance compound, with water to dilute the composition.

27. A composition comprising 15-45 weight % of at least one surfactant, a plurality of film flakes, and water, wherein the composition is capable of suspending the plurality of film flakes, wherein the film flake comprises a polymer system and a beneficial ingredient, wherein the polymer system comprises polyvinyl acetate, and wherein the film flake has a solubility in water of 40% to 60%, wherein the composition is a liquid, and wherein a combination of the surfactant and the water provides the composition with a water activity higher than 0.9.

28. A method of delivering delayed release of fragrance, comprising contacting the composition of claim 27, in which composition the beneficial ingredient is a fragrance compound, with water to dilute the composition.

* * * * *